US011629540B2

(12) United States Patent
Blum et al.

(10) Patent No.: US 11,629,540 B2
(45) Date of Patent: Apr. 18, 2023

(54) GUIDE SYSTEM FOR GUIDING AT LEAST ONE MOVABLY MOUNTED DOOR LEAF

(71) Applicant: Julius Blum GmbH, Hoechst (AT)

(72) Inventors: Lukas Blum, Bregenz (AT); Bernd Koenig, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 179 days.

(21) Appl. No.: 17/353,186

(22) Filed: Jun. 21, 2021

(65) Prior Publication Data

US 2021/0310293 A1 Oct. 7, 2021

Related U.S. Application Data

(63) Continuation of application No. PCT/AT2019/060366, filed on Nov. 5, 2019.

(30) Foreign Application Priority Data

Dec. 20, 2018 (AT) ..... A 51143/2018

(51) Int. Cl.
*E05D 7/04* (2006.01)
*E05D 15/58* (2006.01)
*E05D 15/48* (2006.01)

(52) U.S. Cl.
CPC ..... *E05D 15/58* (2013.01); *E05D 7/0407* (2013.01); *E05D 7/0415* (2013.01);
(Continued)

(58) Field of Classification Search
CPC ..... Y10T 16/547; Y10T 16/5475; Y10T 16/5476; Y10T 16/551; E05D 15/264;
(Continued)

(56) References Cited

U.S. PATENT DOCUMENTS 4,852,212 A * 8/1989 Amann ..... E05D 15/58 16/102
8,231,187 B2 7/2012 Hoffman
(Continued)

FOREIGN PATENT DOCUMENTS

CN 107002439 8/2017
CN 108086842 5/2018
(Continued)

OTHER PUBLICATIONS

International Search Report dated Jan. 17, 2020 in International (PCT) Application No. PCT/AT2019/060366.
(Continued)

*Primary Examiner* — Chuck Y Mah
(74) *Attorney, Agent, or Firm* — Wenderoth, Lind & Ponack, L.L.P.

(57) ABSTRACT

A guide system for guiding a door wing includes a first guide rail for guiding the door wing, and a second guide rail for guiding the door wing, with the second guide rail extending transversely relative to the first guide rail. A carrier displaceable along the second guide rail is connected or is to be connected to the door wing via at least three furniture hinges spaced from one another in the mounted condition. All furniture hinges, by which the door wing can be connected or is connected to the carrier in the mounted condition, are arranged or can be arranged on a common mounting member separate from the carrier. The mounting member is releasably connected to the carrier by a fastening device, and the mounting member is releasably connected to the carrier in a direction extending transversely to a longitudinal axis of the carrier.

15 Claims, 11 Drawing Sheets

(52) U.S. Cl.
CPC .. *E05D 2015/485* (2013.01); *E05D 2015/586* (2013.01); *E05Y 2900/20* (2013.01)

(58) Field of Classification Search
CPC ..... E05D 15/34; E05D 15/28; E05D 15/30; E05D 15/32; E05D 15/58; E05D 3/06; E05D 3/08; E05D 3/14; E05D 3/16; E05D 7/0407; E05D 7/0415; E05D 2003/166; E05D 2015/485; E05D 2015/586; E06B 7/36; E06B 7/367; E05Y 2900/20; E05Y 2900/212
See application file for complete search history.

(56) References Cited

U.S. PATENT DOCUMENTS

| | | | | |
|---|---|---|---|---|
| 9,057,216 | B2 | 6/2015 | Bortoluzzi et al. | |
| 9,284,761 | B2 | 3/2016 | Haab et al. | |
| 9,624,705 | B2 | 4/2017 | Haab et al. | |
| 10,400,493 | B2 | 9/2019 | Gabl | |
| 11,008,791 | B2 | 5/2021 | Rupp et al. | |
| 2004/0239216 | A1* | 12/2004 | Castillo | E05D 15/58 312/322 |
| 2004/0252045 | A1* | 12/2004 | Wu | E05D 15/58 341/176 |
| 2007/0159037 | A1 | 7/2007 | Hoffman | |
| 2010/0314980 | A1 | 12/2010 | Hoffman | |
| 2013/0232878 | A1 | 9/2013 | Bortoluzzi et al. | |
| 2014/0150208 | A1* | 6/2014 | Haab | E05D 11/0054 16/86.2 |
| 2015/0008811 | A1* | 1/2015 | Ishii | E06B 3/5045 312/322 |
| 2016/0047151 | A1* | 2/2016 | Pelekanos | E05D 11/0054 16/237 |
| 2016/0201368 | A1 | 7/2016 | Haab et al. | |
| 2017/0260789 | A1 | 9/2017 | Gabl | |
| 2019/0301216 | A1 | 10/2019 | Rupp et al. | |
| 2019/0301218 | A1 | 10/2019 | Rupp et al. | |
| 2019/0330898 | A1 | 10/2019 | Rupp et al. | |

FOREIGN PATENT DOCUMENTS

| | | |
|---|---|---|
| CN | 108104676 | 6/2018 |
| CN | 108150041 | 6/2018 |
| CN | 108425578 | 8/2018 |
| DE | 10 2014 004 351 | 4/2015 |
| GB | 758932 | 10/1956 |
| JP | 6-37480 | 5/1994 |
| JP | 8-86154 | 4/1996 |
| JP | 8-254064 | 10/1996 |
| JP | 2001-349125 | 12/2001 |
| JP | 2014-500417 | 1/2014 |
| JP | 2014-116447 | 6/2014 |
| TW | 201829897 | 8/2018 |
| TW | 201837292 | 10/2018 |
| TW | 201839244 | 11/2018 |
| WO | 2018/129568 | 7/2018 |
| WO | 2018/129574 | 7/2018 |

OTHER PUBLICATIONS

Search Report issued Apr. 8, 2022 in corresponding Chinese Patent Application No. 201980084092.7.

* cited by examiner

GUIDE SYSTEM FOR GUIDING AT LEAST ONE MOVABLY MOUNTED DOOR LEAF

BACKGROUND OF THE INVENTION

The present invention relates to a guide system for guiding at least one movably-supported door wing relative to a furniture carcass. The guide system includes a first guide rail for guiding the at least one door wing, and a second guide rail for guiding the at least one door wing, in which the second guide rail extends transversely relative to the first guide rail in a mounted condition. A carrier is configured to be displaceable along the second guide rail, and the carrier is connected or is configured to be connected to the at least one door wing via at least three furniture hinges arranged or to be arranged spaced from one another in the mounted condition, and the carrier has a longitudinal axis.

Moreover, the invention relates to an item of furniture comprising a furniture carcass, at least one door wing movably supported relative to the furniture carcass, and a guide system of the type to be described for moving the at least one door wing relative to the furniture carcass.

Moreover, the invention relates to a method for mounting a door wing to a carrier of a guide system of the type to be described.

A guide system for two door wings which are hingedly connected to one another and which can be inserted into a lateral insertion compartment of the furniture carcass via a carrier is shown, for example, in WO 2018/129574 A1.

US 2007/159037 A1 discloses a non-generic guide system for moving a door wing of a media cabinet. In a first position, the door wing covers the furniture carcass, so that a monitor arranged within the furniture carcass can be covered for example. In a further position, the door wing can be laterally inserted into the furniture carcass, so that an unhindered view onto the monitor can be made possible. A displacement of the door wing along the front edge of the furniture carcass is not possible due to the lack of a guide rail. In FIG. 5 of the US 2007/159037 A1 reference, it can further be seen that two furniture hinges for pivotally supporting the door wing are each arranged on two holding devices separate from one another. The holding devices, jointly with the furniture hinges and the door wing, can be inserted into the interior of the furniture carcass. A drawback is the fact that the mounting procedure of the door wing is somewhat complicated, because each of the hinge cups of the furniture hinges must be precisely countersunk into corresponding openings of the door wing. Moreover, when the furniture hinges are provided with an adjustment device, the adjustments of the furniture hinges must be coordinated to one another. Otherwise, this would lead to a misalignment, to a strain or to a jamming of the door wing.

US 2013/0232878 A1 discloses a guide system for a door wing which can be inserted into a lateral insertion compartment of a furniture carcass via a vertically extending carrier. For supporting the door wing, a plurality of hinges is provided, and the hinges can be arranged on a common profiled rail separate from the carrier. For mounting the profiled rail, the profiled rail must be slid onto the carrier in a longitudinal direction. In order for profiled rail to be slid onto the vertically extending carrier on-site, a sufficient space must be present in a height direction. However, such a space is not available in most mounting situations.

SUMMARY OF THE INVENTION

It is an object of the present invention to propose a guide system of the type mentioned in the introductory part, thereby avoiding the above-discussed drawbacks.

According to the invention, all furniture hinges, by which the at least one door wing can be connected or is connected to the carrier in the mounted condition, are arranged or can be arranged on a common mounting member separate from the carrier. The mounting member is configured to be releasably connected to the carrier by at least one fastening device, and the mounting member is configured to be releasably connected to the carrier in a direction extending transversely to the longitudinal axis of the carrier.

Accordingly, in a first mounting step, the at least one door wing can be fixed to the mounting member via the furniture hinges. In a further mounting step, the mounting member—jointly with the door wing fixed thereon—can be slid onto the carrier in a direction extending transversely to the longitudinal axis of the carrier (for example from the front). Therefore, a comfortable and easily performed mounting operation of the door wing to the carrier can be afforded.

According to an embodiment, the mounting member can be releasably connected to the carrier by sliding onto, by pushing onto or by hanging the mounting member into the carrier.

All furniture hinges provided for fixing the at least one door wing are arranged or can be arranged on a common mounting member separate from the carrier. As a result, the mounting member, jointly the furniture hinges pre-mounted thereon, can be fixed as a common constructional unit to the carrier via at least one fastening device. Accordingly, it is not necessary to mount the furniture hinges individually to the carrier. A special advantage of the invention lies in the fact that a position of the mounting member—jointly with the furniture hinges arranged thereon—can be adjusted relative to the carrier by at least one adjustment device. As a result, all furniture hinges provided for fixing the door wing can be synchronically and uniformly adjusted relative to the carrier upon an adjustment of the mounting member. By a synchronous adjustment of the furniture hinges, strains or jammings of the door wing can be practically excluded.

The furniture hinges are either already pre-mounted to the common mounting member or, alternatively, can be configured to be releasably fixed to the mounting member. For the purpose of releasably fixing the furniture hinges, recesses and/or locking elements may be arranged or formed on the mounting member, and the furniture hinges can be releasably locked (for example snapped) to the mounting member by the recesses and/or by the locking elements.

According to an embodiment, at least four furniture hinges are arranged or can be arranged on the mounting member. The number of the furniture hinges certainly depends on the respective height and on the weight of the door wing. Therefore, more than four furniture hinges can also be provided on the mounting member, and the furniture hinges are spaced from one another in a longitudinal direction of the mounting member in a mounted condition.

For example, the mounting member can be configured as a longitudinally extending rail. Preferably, the rail, in a connected condition with the carrier, bears against the carrier substantially over its entire length.

The mounting member can have a one-piece configuration or also a multi-part configuration. With a multi-part configuration of the mounting member, two or more partial portions can be provided, and the partial portions are configured to be fixed to one another (for example by a fastening adaptor and/or by screws). As a result, the mounting member, as a finished module, includes at least three furniture hinges for fixing the at least one door wing.

The at least one fastening device for fixing the mounting member to the carrier can include, for example, at least one protrusion arranged or formed on the carrier or on the mounting member. The protrusion, in a connected condition between the mounting member and the carrier, engages into a recess arranged on the mounting member or on the carrier. Accordingly, the at least one protrusion can be formed or arranged either on the mounting member or on the carrier. In a connected condition with the carrier, the protrusion engages into a corresponding recess of the carrier or of the mounting member. According to an embodiment, at least two protrusions are provided, the protrusions being spaced from one another in a longitudinal direction of the mounting member and/or in a longitudinal direction of the carrier.

As already mentioned before, at least one adjustment device can be provided for adjusting a position of the mounting member relative to the carrier in a connected condition of the mounting member on the carrier. For example, the adjustment device can include at least one rotatably mounted adjustment wheel. By rotating the adjustment wheel, a position of the mounting member relative to the carrier can be adjusted. The at least one adjustment wheel can include a tool receiving device, and the adjustment wheel can be rotated by rotating the tool receiving device with the aid of a tool, for example with a screwdriver.

The method according to the invention for mounting at least one door wing on a carrier of a guide system of the type in question is characterized by the following steps:

- providing a mounting member separate from the carrier, and at least three or more furniture hinges for movably supporting the at least one door wing are arranged or can be arranged on the mounting member,
- connecting the furniture hinges arranged on the mounting member with the at least one door wing, and
- releasably connecting the mounting member to the carrier of the guide system.

According to a further method step, in a connected condition of the mounting member on the carrier, a position of the mounting member relative to the carrier can be adjusted by at least one adjustment device.

BRIEF DESCRIPTION OF THE DRAWINGS

Further details and advantages of the present invention result from the following description of figures.

DETAILED DESCRIPTION OF THE INVENTION

Figure 1A:
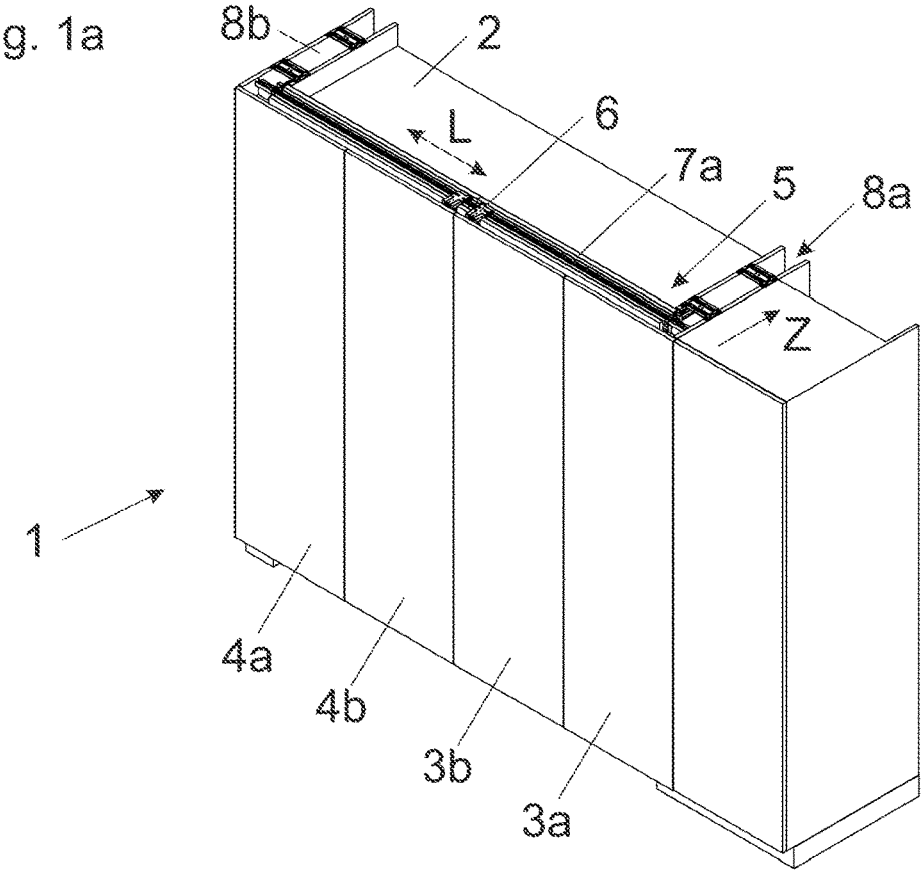
FIG. 1*a*, 1*b* are perspective views of an item of furniture comprising a furniture carcass and door wings movably-supported relative thereto.

FIG. 1*a* shows a perspective view of an item of furniture 1 comprising a furniture carcass 2 and door wings 3*a*, 3*b*, 4*a*, 4*b* movably supported relative thereto. The door wings 3*a*, 3*b*, 4*a*, 4*b* can be moved by a guide system 5 between a first position, in which the door wings 3*a*, 3*b*, 4*a*, 4*b* are aligned substantially coplanar to one another, and a second position, in which the door wings 3*a*, 3*b*, 4*a*, 4*b* are aligned substantially parallel to one another. In the second (parallel) position, the door wings 3*a*, 3*b* can be inserted into a lateral receiving compartment 8*a* of the furniture carcass 2. The other door wings 4*a*, 4*b*, in a parallel position to one another, can be inserted into a further receiving compartment 8*b*. The functionality will be explained in the following with the aid of the door wings 3*a*, 3*b*, and the same descriptions apply to the other door wings 4*a*, 4*b*. The guide system 5 includes a first guide rail 7*a* having a longitudinal axis (L), and a guide carriage 6 configured to be connected to the second door wing 3*b* is displaceably supported along the first guide rail 7*a*.

Figure 1B:
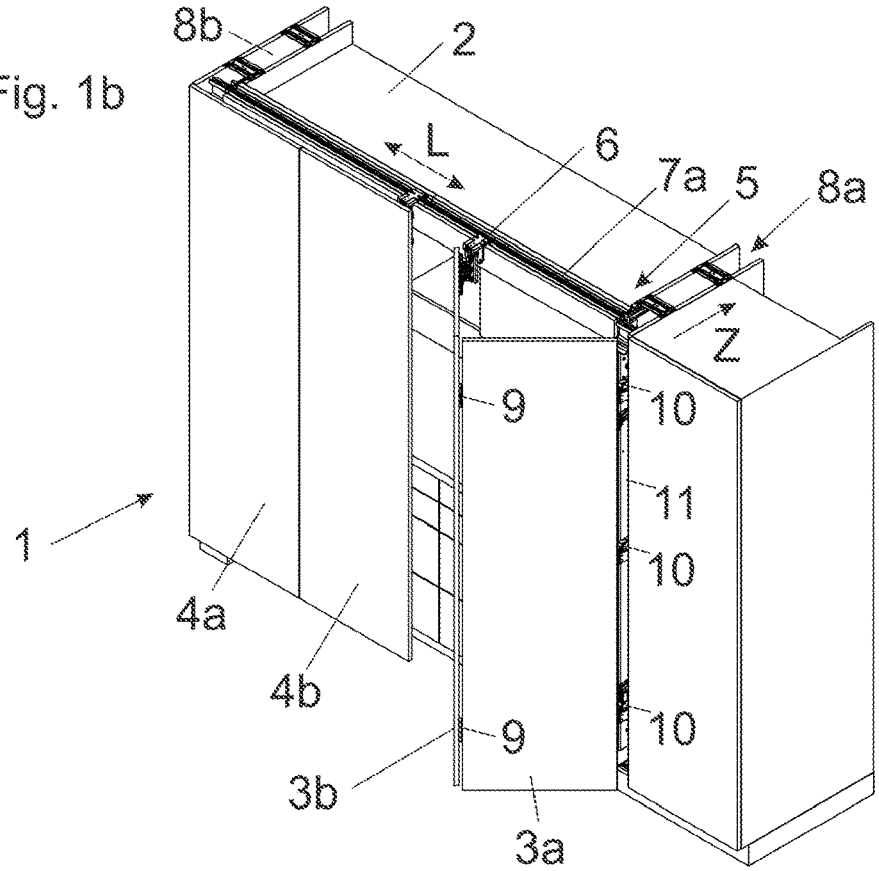

FIG. 1*b* shows the item of furniture 1, in which the door wings 3*a*, 3*b*, from the coplanar position shown in FIG. 1*a*, have been moved into an angled position to one another. The first door wing 3*a* is supported on a carrier 11 via three or more furniture hinges 10. The carrier 11 is configured to be inserted into the receiving compartment 8*a* in a depth direction (Z). The carrier 11, in the shown figure, is located in a transfer position in which the carrier 11 adjoins the first guide rail 7*a* in the longitudinal axis (L) such that the guide carriage 6 can be transferred to and from between the first guide rail 7*a* and the carrier 11. In the shown transfer position, the carrier 11 is releasably locked to the first guide rail 7*a*, and the locking between the first guide rail 7*a* and the carrier 11 can be released by an entry of the guide carriage 6 in or on the carrier 11. The carrier 11 is in the form of a longitudinally extending column, and a length of which corresponds to at least half of a height of the door wings 3*a*, 3*b*. The two door wings 3*a*, 3*b* are hingedly connected to one another about a vertically extending axis via a hinge fitting 9. The second door wing 3*b* is displaceably supported along the first guide rail 7*a* via the guide carriage 6.

Figure 2A:
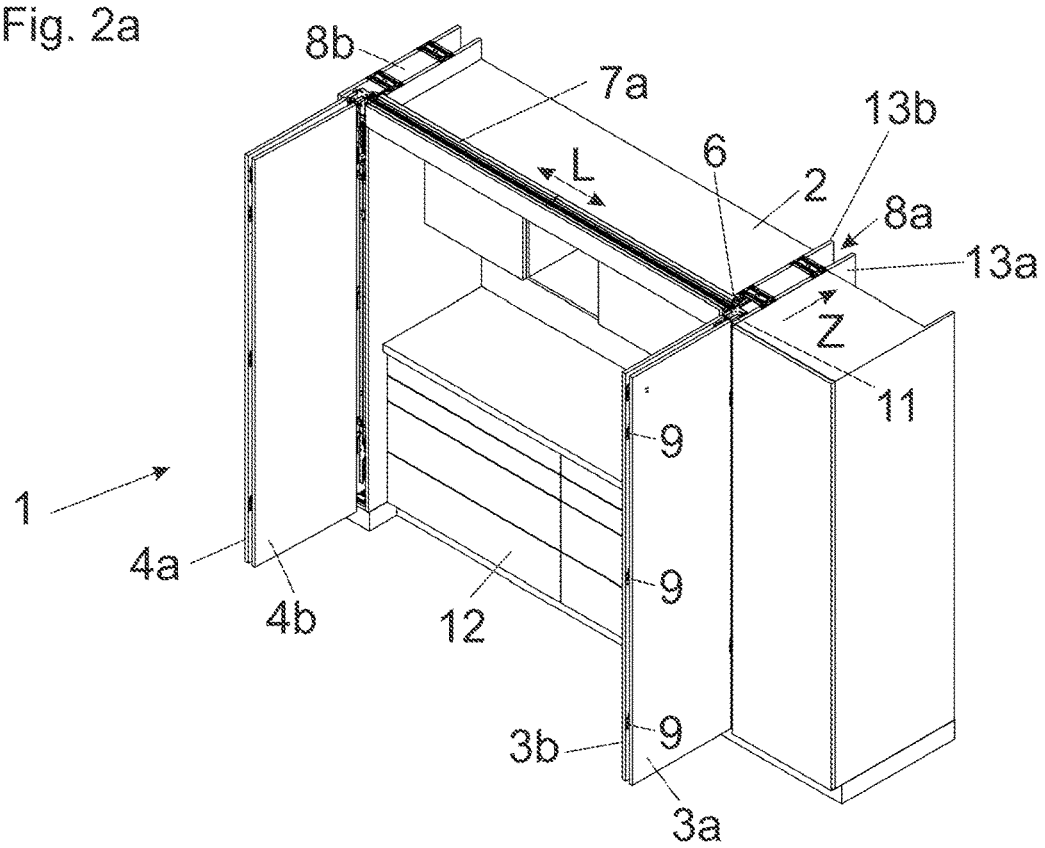
FIG. 2*a*, 2*b* show the item of furniture according to FIGS. 1*a*, 1*b* with the door wings in further positions to one another.

FIG. 2*a* shows the item of furniture 1 with the door wings 3*a* and 3*b* which are now aligned parallel to one another. The carrier 11 has been unlocked from the first guide rail 7*a* by an entry of the guide carriage 6, so that the carrier 11 (jointly with the guide carriage 6 and the door wings 3*a*, 3*b*) can be inserted into the receiving compartment 8*a* in the depth direction (Z) along a second guide rail 7*b* (not shown) of the guide system 5, the second guide rail 7*b* extending transversely to the longitudinal axis (L) of the first guide rail 7*a*.

Figure 2B:
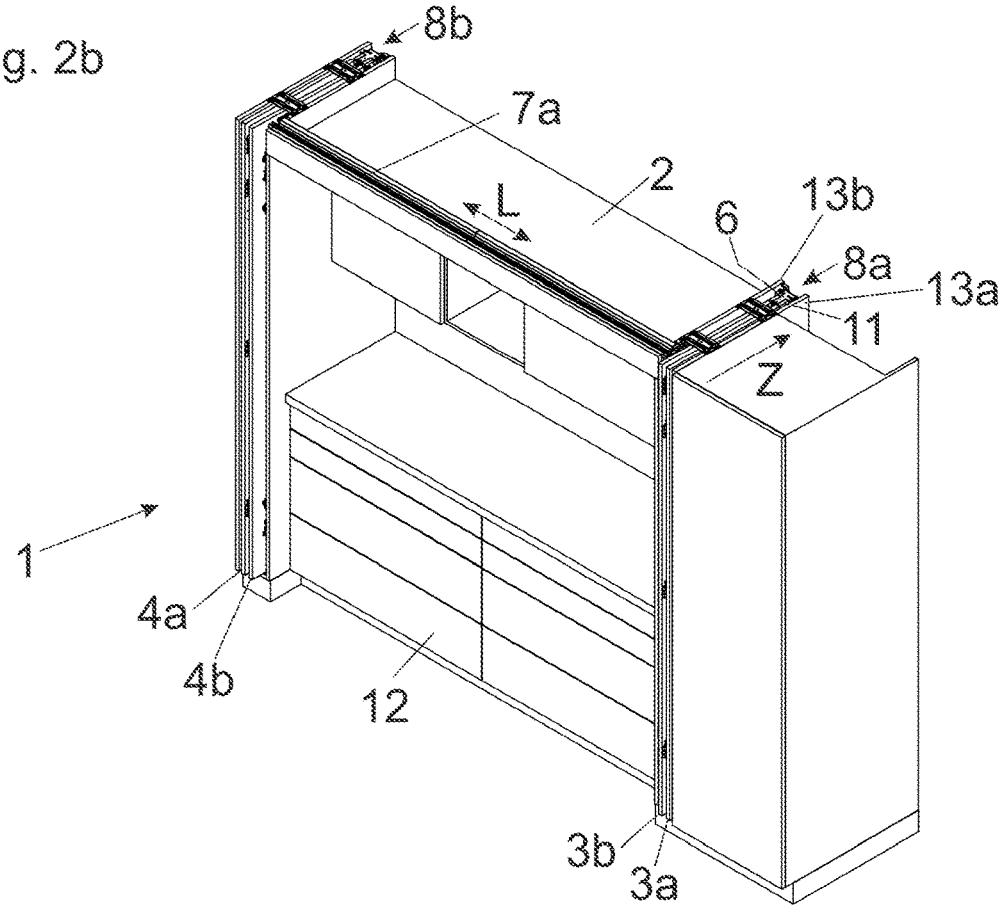

FIG. 2*b* shows the item of furniture 1 with the door wings 3*a*, 3*b* which are now located in a fully inserted condition within the receiving compartment 8*a*. The door wings 3*a*, 3*b* are thus movably supported by the guide system 5 from a first position according to FIG. 1*a*, in which the door wings 3*a*, 3*b* are aligned substantially coplanar to one another, and a second position according to FIG. 2*b*, in which the door wings 3*a*, 3*b* are aligned substantially parallel to one another and can be accommodated within the receiving compartment 8*a*. In this way, for example, a kitchen 12 as shown in FIGS. 2*a*, 2*b* can be fully concealed, so that the kitchen 12 can be visually separated from a remaining area of a living room. In the shown embodiment, the receiving compartment 8*a* is formed by a sidewall 13*a* and by a stationary furniture part 13*b* spaced in a parallel relationship from the sidewall 13*a*. The two door wings 3*a*, 3*b* can be inserted between the sidewall 13*a* and the stationary furniture part 13*b* when the two door wings 3*a*, 3*b* are aligned in a parallel position to one another.

Figure 3:
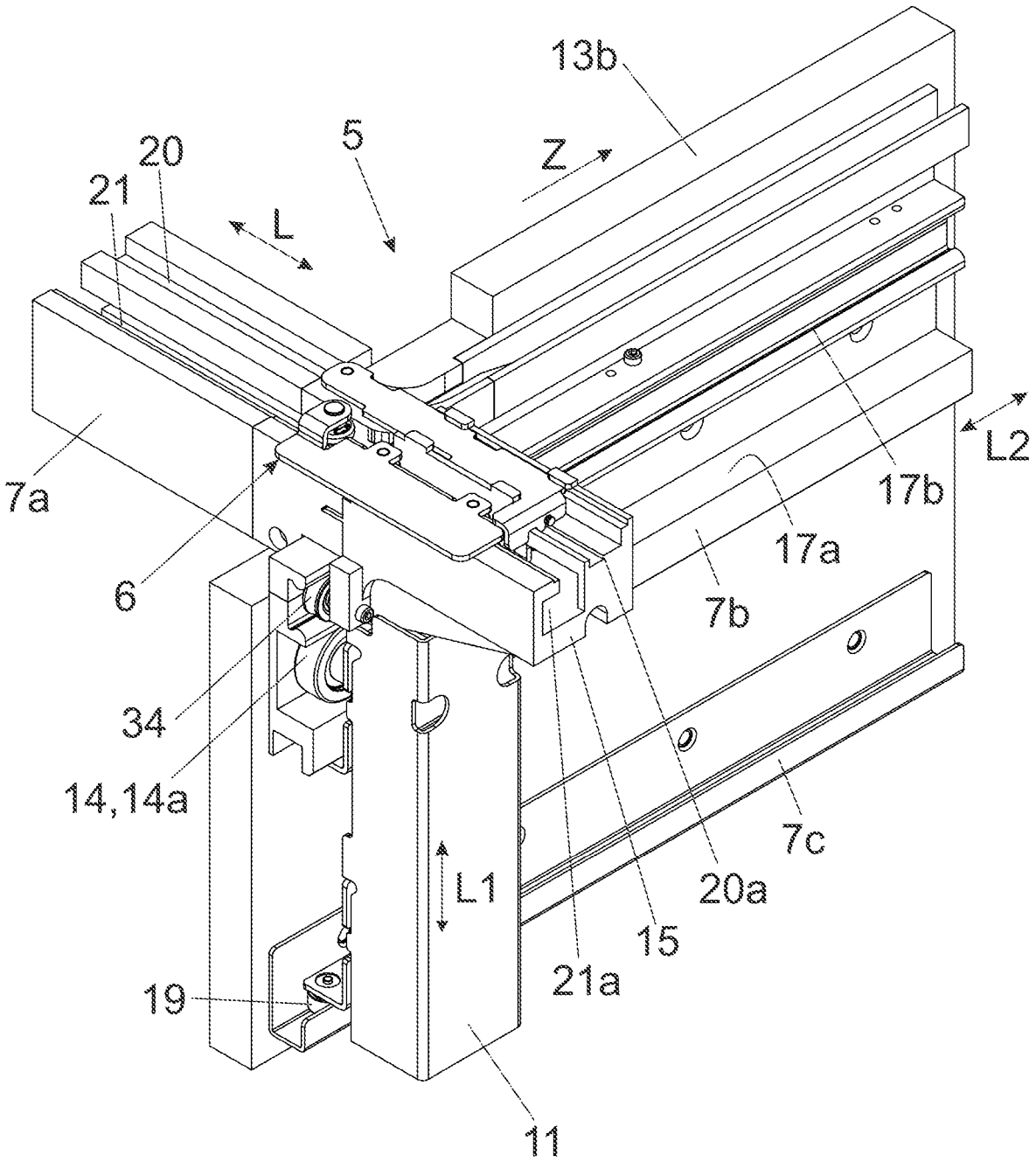
FIG. 3 is a perspective view of the guide system.

FIG. 3 shows a perspective view of the guide system 5 in a region between the sidewall 13*a* and the stationary furniture part 13*b*, between which the receiving compartment 8*a* for receiving the door wings 3*a*, 3*b* is formed. The first guide rail 7*a* has a longitudinal axis (L) extending parallel to a front edge of the furniture carcass 2 in a mounted condition. A second guide rail 7*b* having a longitudinal axis (12) is arranged on the stationary furniture part 13*b*, the longitudinal axis (L) of the first guide rail 7*a* and the longitudinal axis (12) of the second guide rail 7*b* extending transversely, preferably substantially at a right angle, to one another. The carrier 11 is configured for movably supporting the at least one door wing 3*a*. The door wing 3*a*, in a mounted condition, is pivotally supported about a vertically extending axis on the carrier 11 via at least three or more furniture hinges 10 (see FIG. 1*b*). The carrier 11 includes at least one guide device 14 for moving the carrier 11 along the second guide rail 7*b* in the depth direction (Z) and in a direction opposite the depth direction (Z). In the shown figure, the guide device 14 of the carrier 11 includes at least one running wheel 14*a* movably supported along a first running limb 17*a* of the second guide rail 7*b*.

In the shown embodiment, the carrier 11 is configured to be releasably locked to the first guide rail 7*a* via a receiving device 15. The receiving device 15 is configured to receive the displaceable guide carriage 6, so that the guide carriage 6 can be moved from the first guide rail 7*a* into the receiving device 15. For this purpose, guide grooves 20, 21 may be arranged in the first guide rail 7*a*, the guide grooves 20, 21 extending along the longitudinal axis (L) of the first guide rail 7*a* and being aligned, in the transfer position of the receiving device 15, flush with corresponding guide grooves 20*a*, 21*a* of the receiving device 15. In this way, the running wheels of the guide carriage 6 can be displaced between the first guide rail 7*a* and the receiving device 15 without a disturbing abutting edge.

For the improved decoupling between the receiving device 15 and the carrier 11, it can be provided that the receiving device 15 includes at least one supporting roller 34 separate from the guide device 14 of the carrier 11, and the at least one supporting roller 34 is configured to run along the second guide rail 7*b*. It can be preferably provided that the second guide rail 7*b* includes a first running limb 17*a* and at least one second running limb 17*b* separate from the first running limb 17*a*. The running wheel 14*a* of the guide device 14 is movably supported along the first running limb 17*a* of the second guide rail 7*b*, and the at least one supporting roller 34 of the receiving device 15 is movably supported along the second running limb 17*b* of the second guide rail 7*b*.

The carrier 11 and the receiving device 15 are connected to one another in a movement-coupled manner upon a movement along the second guide rail 7*b* in the depth direction (Z). It can be preferably provided that the receiving device 15 and the carrier 11, upon a movement along the second guide rail 7*b* in the depth direction (Z) and in a direction opposite the depth direction (Z), are coupled to one another in a play-free manner. For the improved support of the carrier 11, at least one further guide rail 7*c* can be provided, and a further running wheel 19 of the carrier 11 is displaceably supported along the further guide rail 7*c*.

Figure 4:
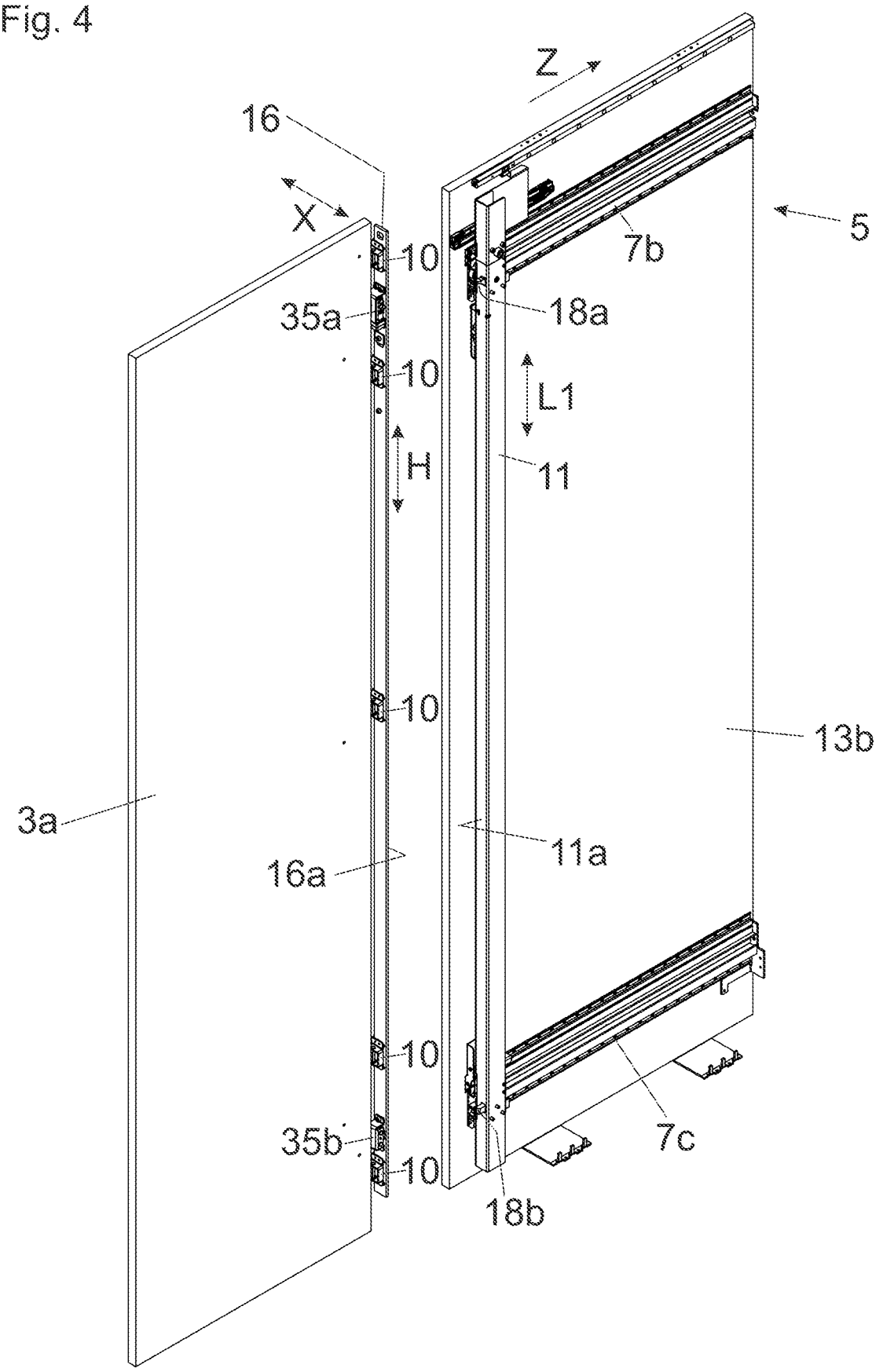
FIG. 4 is a perspective view of the door wing with the mounting member pre-mounted thereon for fixing to the carrier.

FIG. 4 shows a perspective view of the door wing 3*a*, and a mounting member 16 for fixing to the carrier 11 is pre-mounted to the door wing 3*a*. At least three (in the present case five) furniture hinges 10 are arranged on the mounting member 16 for pivotally supporting the door wing 3*a*. In the shown figure, the mounting member 16 is configured as a rail extending along the longitudinal axis (L1) of the carrier 11, and the rail may have a one-piece configuration or also a multi-part configuration. The mounting member 16 is configured to be releasably connected to the carrier 11 in a direction extending transversely to the longitudinal axis (L1) of the carrier 11, preferably by hanging the mounting member 16 into to carrier 11.

The mounting member 16 includes at least one flat-shaped bearing surface 16*a* bearing against a flat-shaped bearing surface 11*a* of the carrier 11 in a connected condition with the carrier 11. By at least one adjustment device 35*a*, 35*b* separate from the furniture hinges 10, a position of the mounting member 16 relative to the carrier 11 can be adjusted in the connected condition. Preferably, a position of the mounting member 16 relative to the carrier 11 can be adjusted by the upper adjustment device 35*a* in a lateral direction (X) and in a height direction (H), whereas a position of the mounting member 16 relative to the carrier 11 can be adjusted by the lower adjustment device 35*b* only in a lateral direction (X).

The mounting member 16 is configured to be fixed to the carrier 11 via at least one fastening device 18*a*, 18*b*. In the shown embodiment, each of the fastening devices 18*a*, 18*b* includes a protrusion 19*a*, 19*b* (FIG. 5) arranged on the carrier 11. In a connected condition of the mounting member 16, the protrusions 19*a*, 19*b* engage in a corresponding recess 36*a*, 36*b* of the mounting member 16. According to an embodiment, it can be provided that the protrusions 19*a*, 19*b* of the fastening devices 18*a*, 18*b* co-operate with the adjustment devices 35*a*, 35*b* of the mounting member 16. As a result, a position of the mounting member 16 relative to the carrier 11 can be varied by the protrusions 19*a*, 19*b* of the fastening devices 18*a*, 18*b*. In a connected condition of the mounting member 16, the carrier 11 (jointly with the mounting member 16 and the door wing 3*a* fixed to the furniture hinges 10) can be displaced along the second guide rail 7*b* in the depth direction (Z) and in a direction opposite the depth direction (Z). The further guide rail 7*c*, in the shown figure, is arranged in a region close to the bottom of the stationary furniture part 13*b*.

Figure 5:
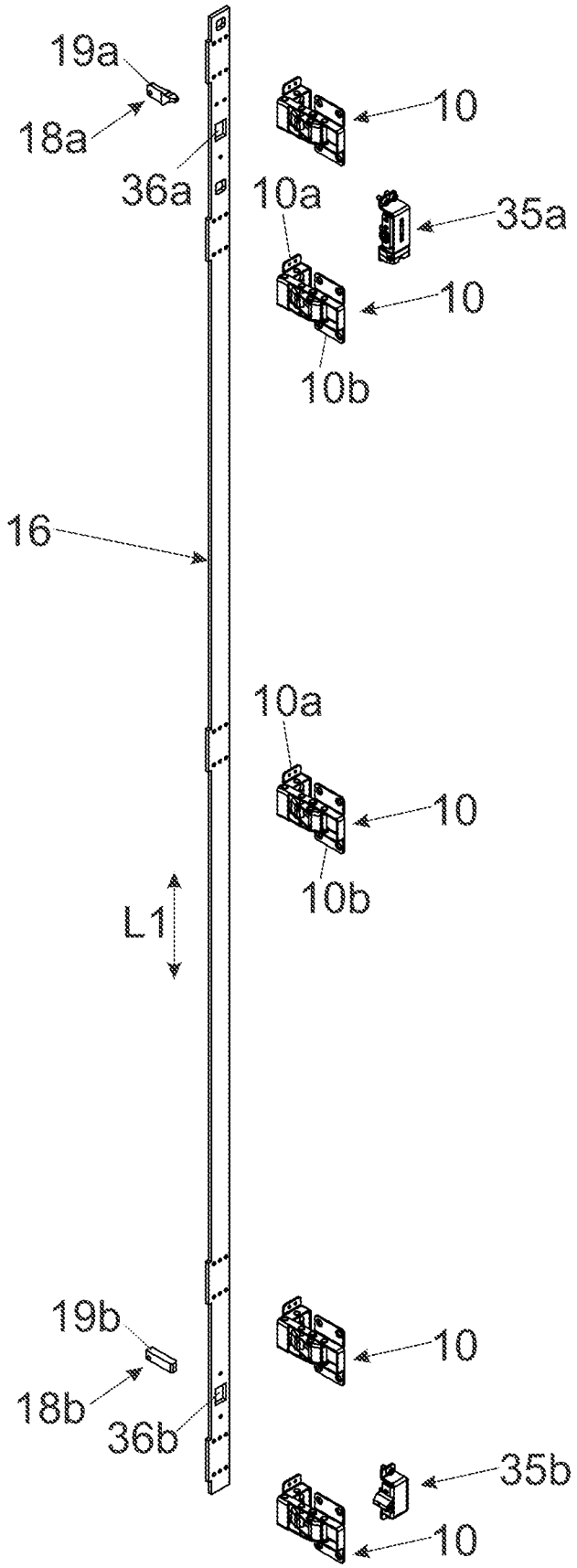
FIG. 5 is an exploded view of the mounting member with the furniture hinges.

FIG. 5 shows the mounting member 16 with the furniture hinges 10 and the adjustment devices 35*a*, 35*b* in an exploded view. The mounting member 16 can be configured as a rail extending along the longitudinal axis (L1), and the furniture hinges 10, in a fixed condition, are spaced from one another along the longitudinal axis (L1). Each of the furniture hinges 10 includes a first fitting portion 10*a* configured to be fixed to the mounting member 16 and a second fitting portion 10*b* configured to be fixed to the door wing 3*a*. The first fitting portion 10*a* and the second fitting portion 10*b* are pivotally connected to one another by at least one hinge axis, preferably by at least five hinge axes. The first fitting portions 10*a* of the furniture hinges 10 can either be screwed to the mounting member 16 or can be configured to be releasably locked to the mounting member 16. Each of the fastening devices 18*a*, 18*b* includes a protrusion 19*a*, 19*b* arranged on the carrier 11, the protrusions 19*a*, 19*b* engaging in corresponding recesses 36*a*, 36*b* of the mounting member 16 in a connected condition between the mounting member 16 and the carrier 11. Each of the protrusions 19*a*, 19*b* is configured to co-operate with the adjustment devices 35*a*, 35*b*, so that a position of the mounting member 16 relative to the carrier 11 can be adjusted by an actuation of the adjustment devices 35*a*, 35*b* so as to vary a relative position between the mounting member 16 and the protrusions 19*a*, 19*b*.

Figure 6:
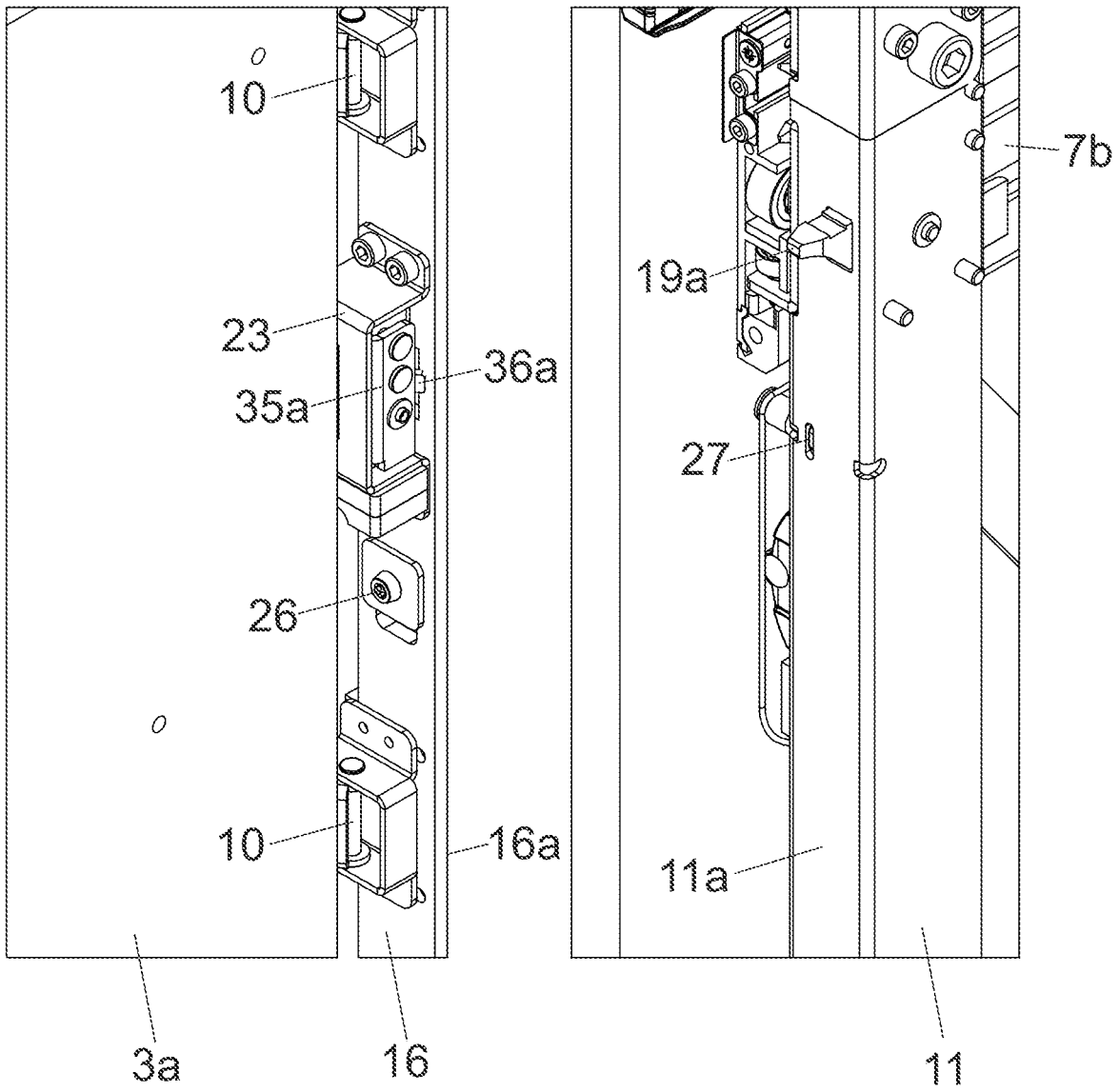
FIG. 6 is a perspective view of the carrier and the mounting member configured to be fixed to the carrier.

FIG. 6 shows the mounting member 16 configured to be fixed to the carrier 11, and the furniture hinges 10 are arranged on the mounting member 16 for movably supporting the door wing 3*a*. For fixing the mounting member 16, the mounting member 16 is placed with its flat-shaped bearing surface 16*a* against the flat-shaped bearing surface 11*a* of the carrier 11, and the protrusion 19*a* of the carrier 11 engages into the corresponding recess 36*a* of the mounting member 16. The protrusion 19*a* introduced into the recess 36*a* is configured to co-operate with the adjustment device 35*a*, the adjustment device 35*a* being fixed to the mounting member 16 by a holding device 23. For fixing the mounting member 16, at least one or a plurality of fastening screws may be used, the fastening screws engaging in an elongated hole 27 of the carrier 11 in a mounted condition. However, in order for the mounting member 16 to remain adjustable relative to the carrier 11 in a connected condition, the fastening screws 26 may have a cut-in for example, whereby the mounting member 16 can be arranged with a radial play with respect to the fastening screw 26, despite the fastening screw 26 being in a tightened condition.

Figure 7A:
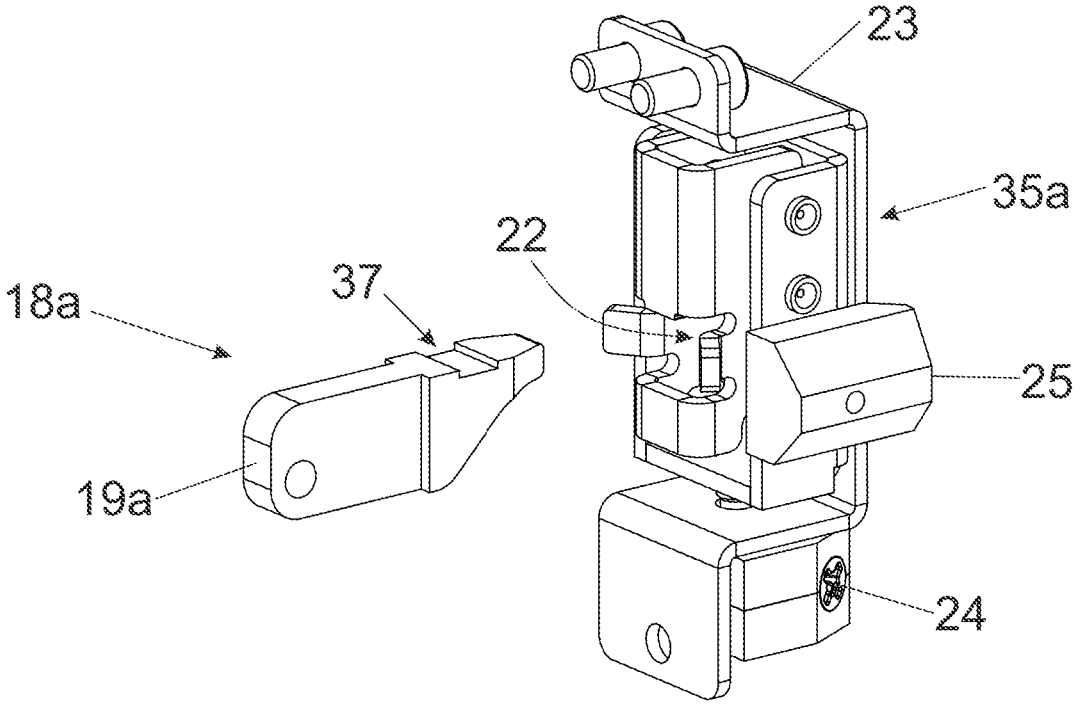
FIG. 7*a*, 7*b* show the protrusion of the fastening device in a released condition and in a fixed condition on the adjustment device.

FIG. 7*a* shows the protrusion 19*a* of the fastening device 18*a* in a released condition on the adjustment device 35*a*, the protrusion 19*a* being configured to be fixed to the carrier 11. The adjustment device 35*a* can be connected to mounting member 16 via the holding device 23. The protrusion 19*a* includes at least one recess 37 for holding the mounting member 16, and the protrusion 19*a* can be inserted into an insertion opening 22 of the adjustment device 35*a*.

Figure 7B:
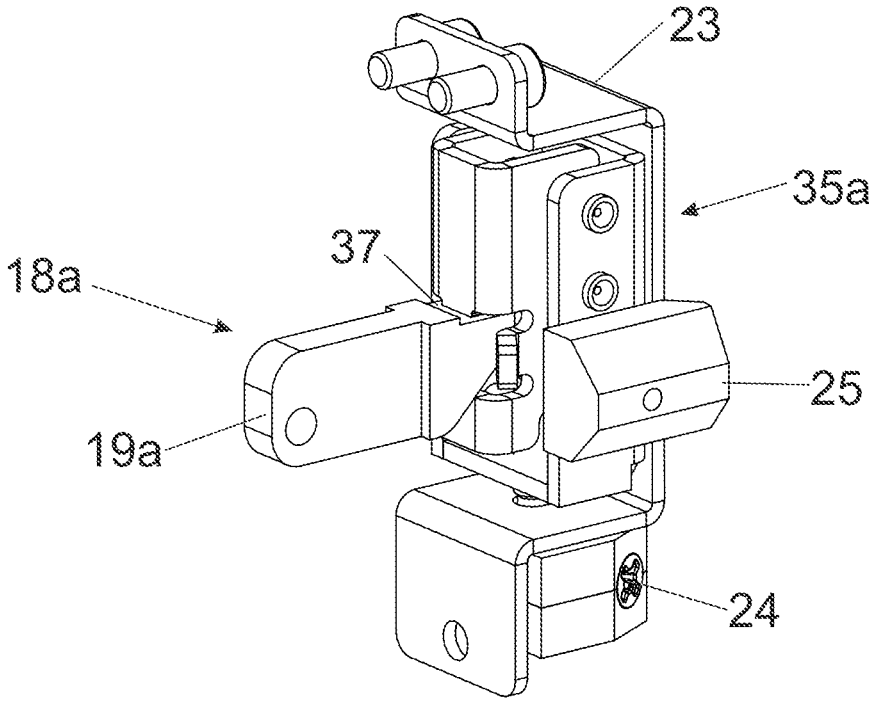

FIG. 7*b* shows the fixed condition of the protrusion 19*a* on the adjustment device 35*a*, and a component of the adjustment device 35*a* is received within the recess 37. The adjustment device 35*a* includes a height adjustment device 24 for adjusting the holding device 23 (and therewith the mounting member 16) in a height direction (H) in the mounted condition, whereby the door wing 3*a* can also be adjusted in the height direction (H) relative to the carrier 11. Moreover, a side adjustment device 25 is provided for adjusting the holding device 23 (and therewith the mounting member 16) in a lateral direction (X) in the mounted condition, whereby the door wing 3*a* can also be adjusted in the lateral direction (X) relative to the carrier 11.

Figure 8A:
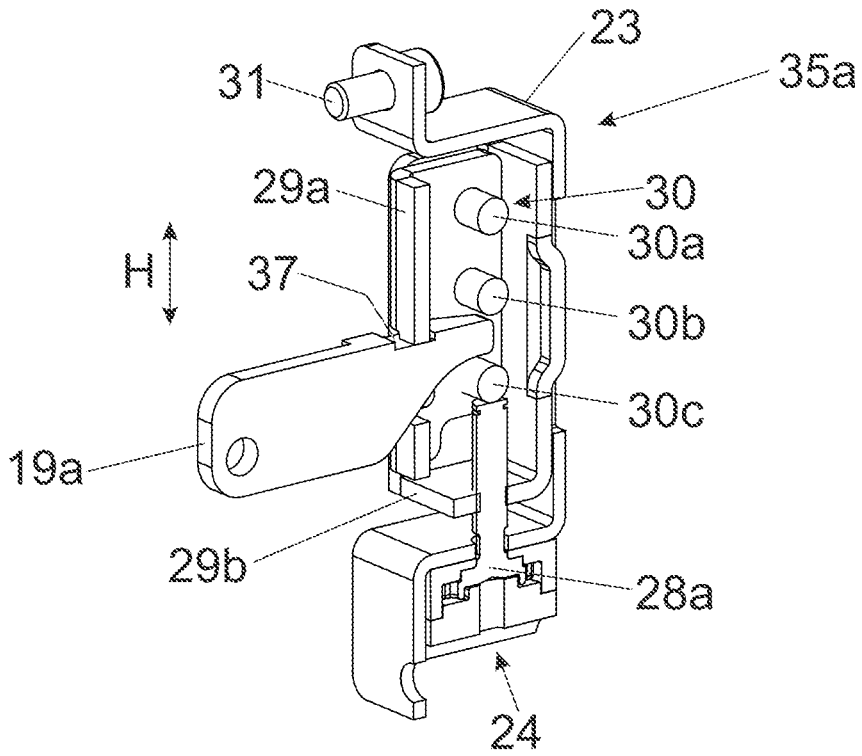
FIG. 8*a*, 8*b* show two different views of the adjustment device for adjusting the mounting member in a height direction and in a lateral direction relative to the carrier.

FIG. 8*a* shows the adjustment device 35*a* in a cross-sectional view, in which the height adjustment device 24 and the side adjustment device 25 (FIG. 8*b*) for adjusting the mounting member 16 relative to the carrier 11 are shown in greater detail. The holding device 23 of the adjustment device 35*a* is to be firmly connected to the mounting member 16 by at least one fastening means 31 (for example a screw). The protrusion 19*a* arranged on the carrier 11 co-operates with a first adjustment portion 29*a* via the recess 37. The first adjustment portion 29*a* is supported within a second adjustment portion 29*b* and is configured to be adjusted relative to the second adjustment portion 29*b* in the lateral direction (X). The second adjustment portion 29*b* (jointly with the first adjustment portion 29*a*) can be adjusted in the height direction (H).

The height adjustment device 24 includes an adjustment wheel 28*a* rotationally supported about a vertically extending rotational axis in a mounted condition. The adjustment wheel 28*a* is in threading engagement with the second adjustment portion 29*b* and can be supported on a pin 30*c* of the second adjustment portion 29*b*. By rotating the adjustment wheel 28*a*, the second adjustment portion 29*b* (jointly with the first adjustment portion 29*a*) can be adjusted relative to the holding device 23 in the height direction (H). As a result, all furniture hinges 10 provided for supporting the door wing 3*a* and arranged on the mounting member 16 can be synchronically adjusted relative to the carrier 11 in the height direction (H).

Figure 8B:
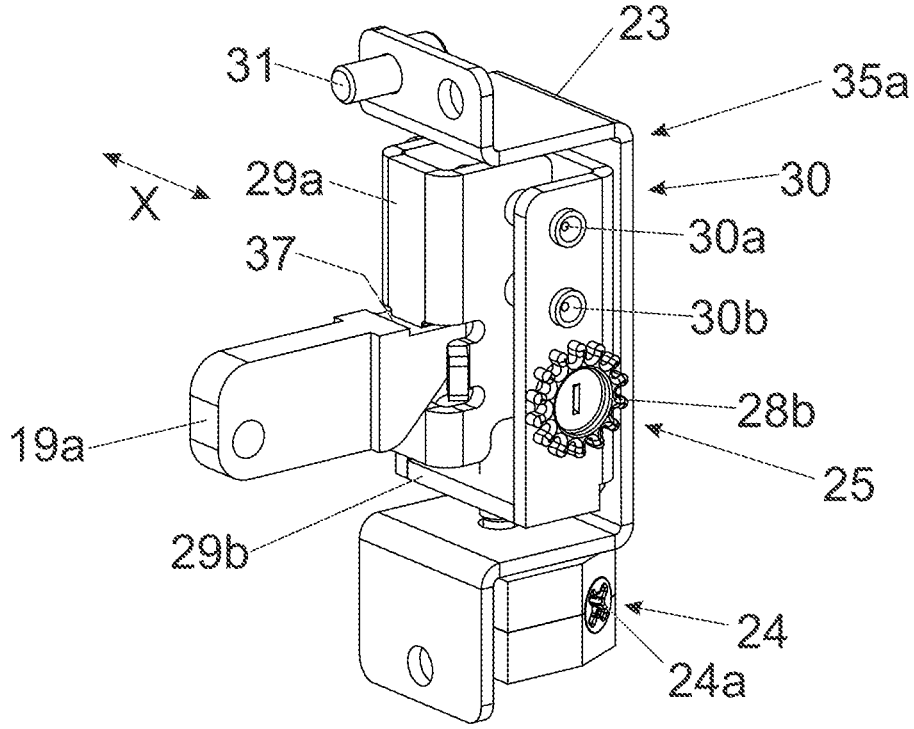

FIG. 8*b* shows the side adjustment device 25 for adjusting the mounting member 16 relative to the carrier 11. The first adjustment portion 29*a* can be adjusted relative to the second adjustment portion 29*b* in the lateral direction (X) by at least one linear guide 30. In the shown embodiment, the linear guide 30 includes two, preferably cylindrical, pins 30*a*, 30*b* for guiding the first adjustment portion 29*a* in the lateral direction (X). The side adjustment device 25 includes a rotationally supported adjustment wheel 28*b* rotationally supported about a horizontally extending rotational axis in the mounted condition, the adjustment wheel 28*b* being in threading engagement with the first adjustment portion 29*a*. By rotating the adjustment wheel 28*b*, the first adjustment portion 29*a* can be adjusted relative to the second adjustment portion 29*b* in the lateral direction (X). As a result, all furniture hinges 10 provided for supporting the door wing 3*a* and arranged on the mounting member 16 can be synchronically adjusted relative to the carrier 11 in the lateral direction (X).

Each of the shown adjustment wheels 28*a*, 28*b* can include a tool receiving device 24*a*, and the adjustment wheels 28*a*, 28*b* can be adjusted by rotating the tool receiving device 24*a* with the aid of a tool. Alternatively, it is also possible that height adjustment device 24 and/or the side adjustment device 25 includes or include at least one drive element separate from the adjustment wheels 28*a*, 28*b*, the at least one drive element having a tool receiving device 24*a* and being movement-coupled to the adjustment wheels 28*a*, 28*b*.

Figure 9:
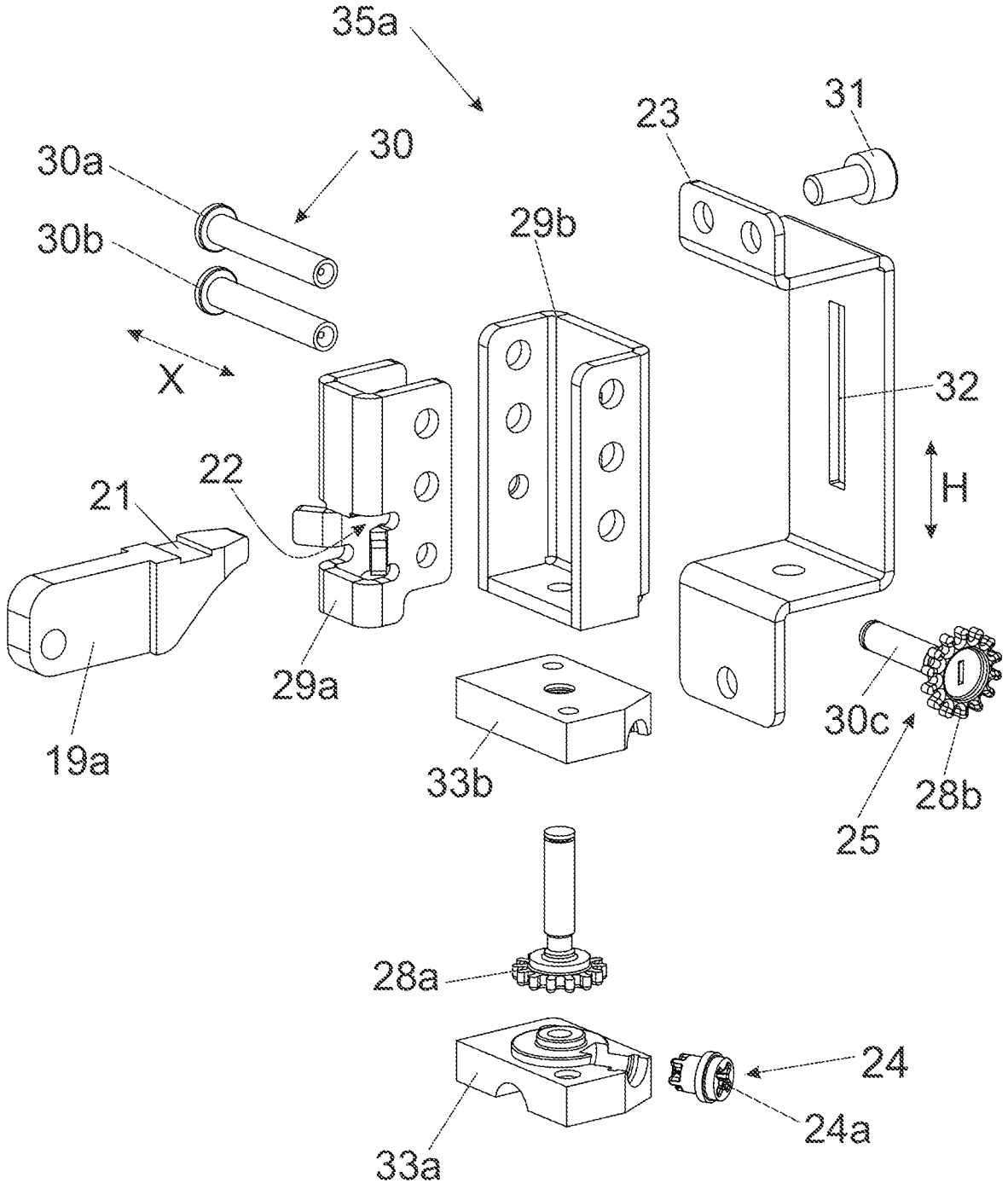
FIG. 9 is an exploded view of the adjustment device for adjusting a position of the mounting member.

FIG. 9 shows the adjustment device 35*a* in an exploded view. The holding device 23 can be fixed to the mounting member 16 via the at least one fastening means 31. The holding device 23 includes a further linear guide 32 for adjusting the second adjustment portion 29*b* in the height direction (H) relative to the holding device 23 by rotating the adjustment wheel 28*a*. The first adjustment portion 29*a* having the insertion opening 22 for inserting the protrusion 19*a* is displaceably supported within the second adjustment portion 29*b* along the two pins 30*a*, 30*b* of the linear guide 30 in the lateral direction (X) by rotating the adjustment wheel 28*a*. The adjustment wheel 28*a* is received between two housing portions 33*a*, 33*b*, and the adjustment wheel 28*a* is configured to be driven by a tool receiving device 24*a* separate from the adjustment wheel 28*a*. The rotational axis of the adjustment wheel 28*a* and the rotational axis of the tool receiving device 24*a* extend transversely to one another, whereby besides an improved accessibility, there is also the possibility to vary the transmission ratio.

Figure 10A:
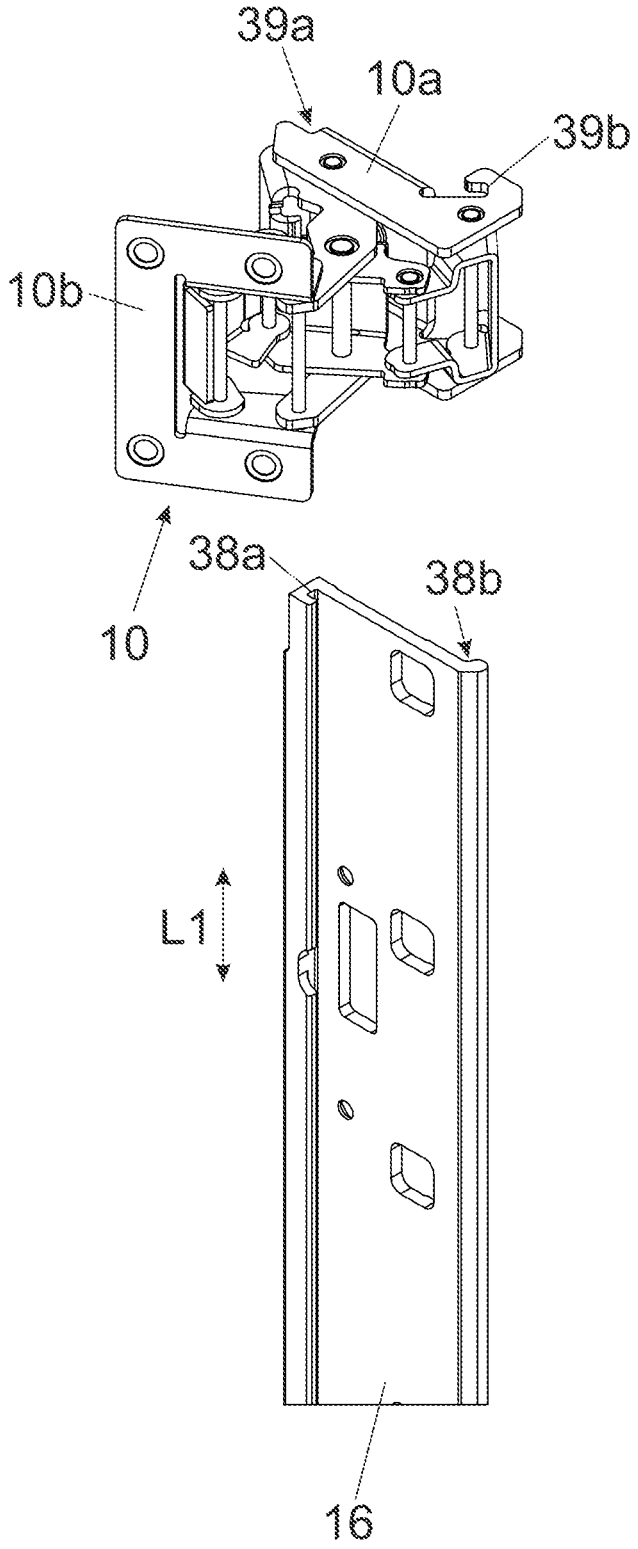
FIG. 10*a*, 10*b* show a furniture hinge configured to be slid onto the mounting member and the furniture hinge in a connected condition.

FIG. 10*a* shows an exemplary possibility for fixing a furniture hinge 10 to the mounting member 16. The mounting member 16 includes at least one linear guide 38*a*, 38*b* extending at least over a region along the longitudinal axis (L1) of the mounting member 16. However, it is also possible that the at least one linear guide 38*a*, 38*b* extends transversely to the longitudinal axis (L1) of the mounting member 16. The furniture hinge 10 includes a first fitting portion 10*a* configured to be fixed to the mounting member 16 and a second fitting portion 10*b* configured to be fixed to the door wing 3*a*, the first fitting portion 10*a* and the second fitting portion 10*b* being hingedly connected to one another. The first fitting portion 10*a* and the second fitting portion 10*b* can be connected to one another by at least five, preferably at least seven, hinge axes (A, B, C, D, E, F, G), as shown in FIG. 11*b*.

Figure 10B:
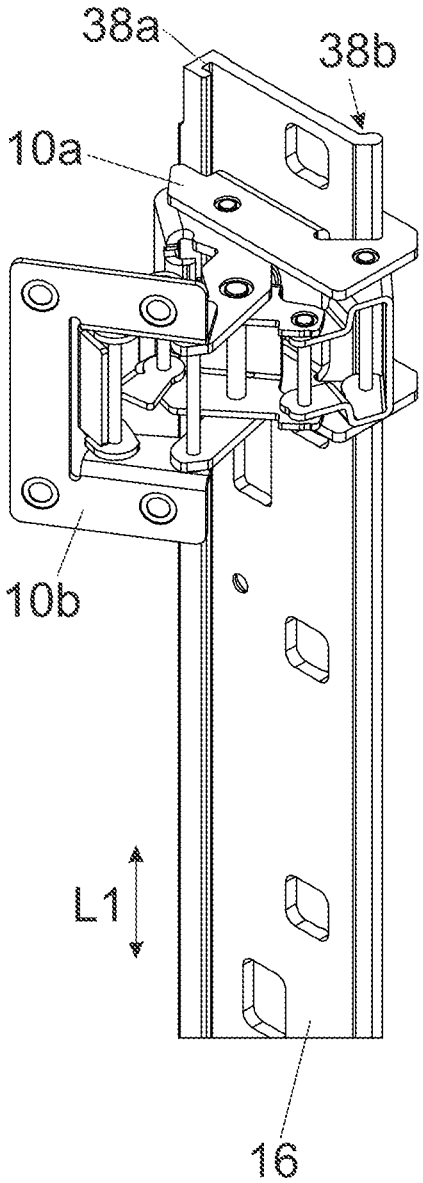

The furniture hinge 10 includes at least one form-locking connection device 39*a*, 39*b* configured to co-operate with the at one linear guide 38*a*, 38*b* of the mounting member 16. In the shown embodiment, the furniture hinge 10 can be slid onto the linear guides 38*a*, 38*b* of the mounting member 16 via the form-locking connection devices 39*a*, 39*b*, and can be displaced along the longitudinal axis (L1) of the mounting member 16. This provides, for example, the possibility to initially fix the furniture hinges 10 to the door wing 3*a* in a first mounting step. In a second mounting step, the furniture hinges 10 pre-mounted to the door wing 3*a* are slid onto the mounting member 16, thereby obtaining their precise position on the mounting member 16. In this way, an easy and rapid assembly of the furniture hinges 10 can be provided, and undesired strains of the furniture hinges 10 on the mounting member 16 can be prevented. By a fixing element 40 (FIG. 11*a*) arranged on the mounting member 16 and/or on at least one of the furniture hinges 10, the furniture hinge 10 can be, preferably clampingly, fixed. FIG. 10*b* shows the connected condition of the furniture hinge 10 on the mounting member 16.

Figure 11A:
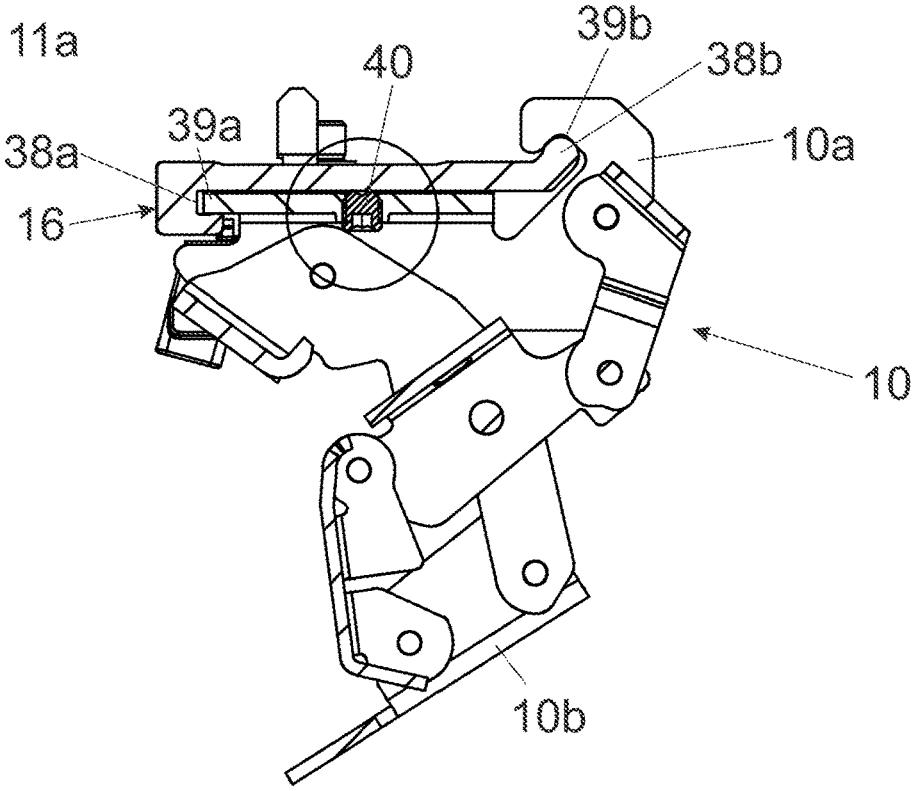
FIG. 11*a*, 11*b* show the furniture hinge arranged on the mounting member in a cross-sectional view and the furniture hinge in an exploded view.

FIG. 11*a* shows the furniture hinge 10 arranged on the mounting member 16 in a cross-sectional view. The form-locking connection devices 39*a*, 39*b* of the furniture hinge 10 co-operate with linear guides 38*a*, 38*b* of the mounting member 16. By at least one fixing element 40, a position of the furniture hinge 10 in relation to the mounting member 16 can be, preferably clampingly, fixed. In the shown embodiment, the fixing element 40 is configured as a rotatable clamping screw which is supported on the first fitting portion 10*a* of the furniture hinge 10 and which can be pressed against the mounting member 16 by rotating the fixing element 40.

Figure 11B:
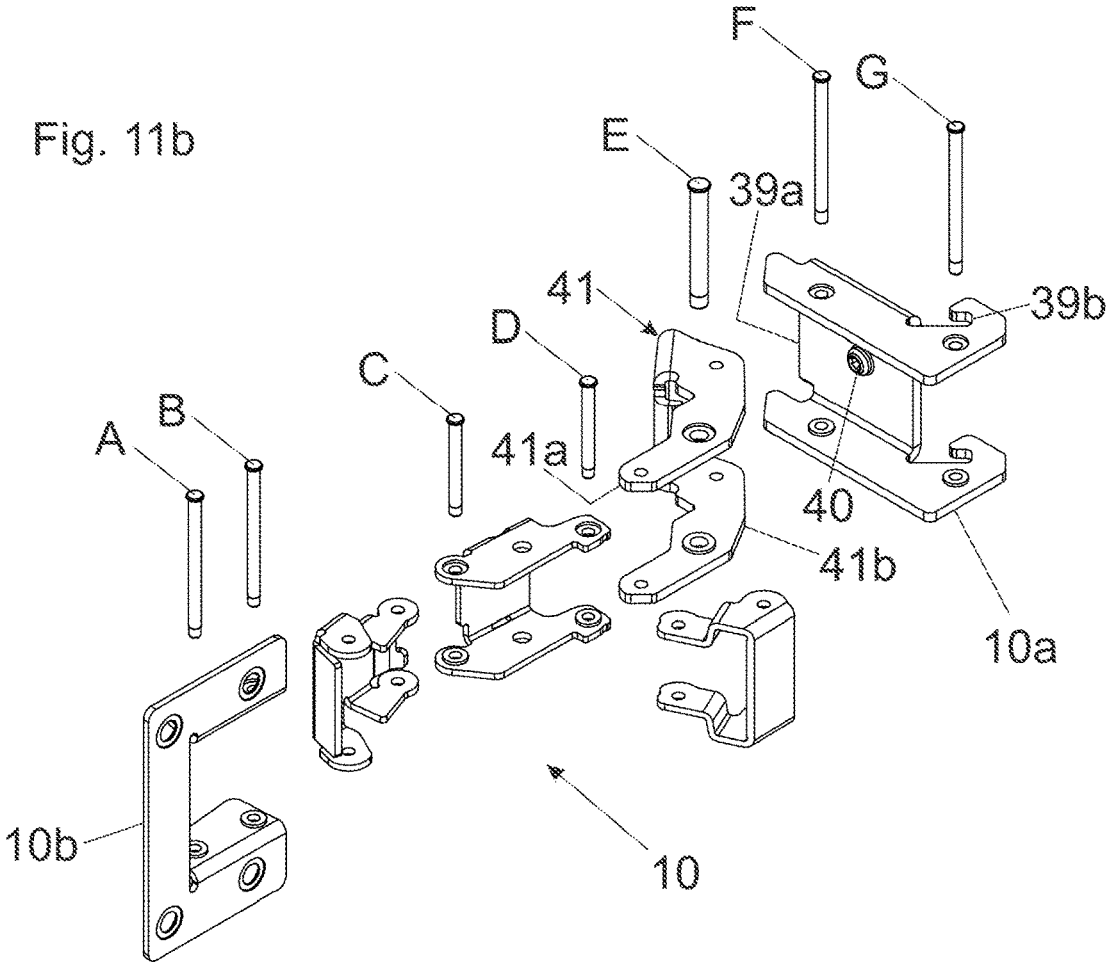

FIG. 11*b* shows the furniture hinge 10 in an exploded view. The first fitting portion 10*a* and the second fitting portion 10*b* are hingedly connected to one another by seven hinge axes (A, B, C, D, E, F, G). At least one, preferably all, supporting lever(s) 41 and/or fitting portion(s) 10*a*, 10*b* of the furniture hinge 10 includes or include at least two partial levers 41*a*, 41*b* spaced from one another along a longitudinal axis of the hinge axes (A, B, C, D, E, F, G). By this doubled configuration of the supporting lever 41, the furniture hinge 10 is, in particular, well suited for receiving high loads.

The invention claimed is:

1. A guide system for guiding at least one door wing movably-supported relative to a furniture carcass, the guide system comprising:

a first guide rail for guiding the at least one door wing, a second guide rail for guiding the at least one door wing, the second guide rail extending transversely relative to the first guide rail in a mounted condition, a carrier configured to be displaceable at least along the second guide rail, the carrier being connected or being configured to be connected to the at least one door wing via at least three furniture hinges which can be arranged or which are arranged spaced from one another in the mounted condition, wherein the carrier has a longitudinal axis, wherein all furniture hinges, by which the at least one door wing can be connected or is connected to the carrier in the mounted condition, are arranged or can be arranged on a common mounting member separate from the carrier, wherein the mounting member is configured to be releasably connected to the carrier by at least one fastening device, and that the mounting member is configured to be releasably connected to the carrier in a direction extending transversely to the longitudinal axis of the carrier.

2. The guide system according to claim 1, wherein at least four furniture hinges are arranged or can be arranged on the mounting member.

3. The guide system according to claim 1, wherein the mounting member is configured as a longitudinally extending rail, wherein it is provided that the rail, in a connected condition with the carrier, bears against the carrier over substantially its entire length.

4. The guide system according to claim 1, wherein the at least one fastening device includes at least one protrusion arranged or formed on the carrier or on the mounting member, and the protrusion, in a connected condition of the mounting member with the carrier, engages into a recess arranged on the mounting member or on the carrier, wherein it is provided that the at least one protrusion includes at least one recess for holding the mounting member or the carrier.

5. The guide system according to claim 1, wherein at least one adjustment device is provided for adjusting a position of the mounting member relative to the carrier in a connected condition of the mounting member on the carrier, wherein it is provided that the at least one adjustment device co-operates with the at least one protrusion of the fastening device.

6. The guide system according to claim 5, wherein the at least one adjustment device includes at least one rotationally supported adjustment wheel, and by rotating the adjustment wheel, a position of the mounting member relative to the carrier can be adjusted, wherein it is provided that the at least one adjustment wheel has a tool receiving device, and the adjustment wheel can be rotated by rotating the tool receiving device with the aid of a tool.

7. The guide system according to claim 5, wherein by the at least one adjustment device, a position of the mounting member relative to the carrier can be adjusted in a lateral direction and/or in a height direction.

8. The guide system according to claim 5, wherein the at least one adjustment device includes at least one linear guide by which the mounting member and the carrier can be adjusted in at least one linear direction to one another.

9. The guide system according to claim 1, wherein at least two adjustment devices are provided for adjusting a position of the mounting member relative to the carrier, wherein the at least two adjustment devices are spaced from one another along a longitudinal axis of the mounting member or along a longitudinal axis of the carrier.

10. The guide system according to claim 1, wherein the at least three furniture hinges include a first fitting portion configured to be fixed to the mounting member and a second fitting portion configured to be fixed to the at least one door wing, wherein the first fitting portion and the second fitting portion are pivotally connected to one another by at least one hinge axis.

11. The guide system according to claim 1, wherein:

the mounting member includes at least one linear guide and at least one of the furniture hinges can be slid onto the mounting member in a longitudinal direction, and/or at least one of the furniture hinges can be connected to the mounting member by a form-locking connection device, and/or at least one fixing element is arranged on the mounting member and/or on at least one of the furniture hinges, the at least one furniture hinge being configured to be, clampingly, fixed to the mounting member via the at least one fixing element.

12. An item of furniture comprising a furniture carcass, at least one door wing movably supported relative to the furniture carcass, and the guide system according to claim 1 for moving the at least one door wing relative to the furniture carcass.

13. The item of furniture according to claim 12, wherein the item of furniture includes at least one second door wing hingedly connected to the at least one door wing, wherein the first door wing and the second door wing are movably supported between a first position, in which the first door wing and the second door wing are aligned substantially coplanar to one another, and a second position, in which the first door wing and the second door wing are aligned substantially parallel to one another.

14. A method of mounting at least one door wing to a carrier of a guide system according to claim 1, comprising:

providing a mounting member separate from the carrier, and at least three or more furniture hinges for movably supporting the at least one door wing are arranged or can be arranged on the mounting member, connecting the furniture hinges arranged on the mounting member to the at least one door wing, and releasably connecting the mounting member to the carrier of the guide system.

15. The method according to claim 14, wherein, in a connected condition of the mounting member on the carrier, a position of the mounting member relative to the carrier is adjusted by at least one adjustment device.

* * * * *